US006247574B1

(12) United States Patent
Yamaguchi et al.

(10) Patent No.: US 6,247,574 B1
(45) Date of Patent: Jun. 19, 2001

(54) ESCALATOR INSTALLATION METHOD

(75) Inventors: Yukihiro Yamaguchi; Masamitsu Yamaki; Chuichi Saito, all of Tokyo (JP)

(73) Assignees: Hitachi, Ltd.; Hitachi Building Systems Co., Ltd., both of Tokyo (JP)

( * ) Notice: Subject to any disclaimer, the term of this patent is extended or adjusted under 35 U.S.C. 154(b) by 0 days.

(21) Appl. No.: 09/525,027

(22) Filed: Mar. 14, 2000

(30) Foreign Application Priority Data

Dec. 16, 1999 (JP) ..... 11-358059

(51) Int. Cl.[7] ..... B66B 21/02

(52) U.S. Cl. ..... 198/326

(58) Field of Search ..... 198/321, 326

(56) References Cited

U.S. PATENT DOCUMENTS 4,811,829 * 3/1989 Nakazawa et al. ..... 198/326
6,129,198 * 10/2000 Nusime ..... 198/326

OTHER PUBLICATIONS

Japanese Patent Unexamined Publication No. 7–179282.

Japanese Patent Unexamined Publication No. 7–179283.

Japanese Patent Unexamined Publication No. 7–179284.

* cited by examiner

*Primary Examiner*—James R. Bidwell
(74) *Attorney, Agent, or Firm*—Antonelli, Terry, Stout & Kraus, LLP

(57) ABSTRACT

An object of the present invention is to provide an escalator installation method by which the installation operation can be conducted with the high operation efficiency and an escalator can be stably installed. In an architectural structure having a stairway, the present invention comprises: a first process for forming a lower pit in a lower floor positioned on the lower side of the stairway; a second process for forming an upper pit in an upper floor positioned on the upper side of the stairway; and a third process for accommodating a lower flat portion of an escalator constituted by an integral structure in the lower pit with the part of the stairway positioned between the upper pit and the lower pit being maintained so as not to be drilled, accommodating an upper flat portion in the upper pit, and setting an inclined portion of the escalator above the part of the stairs positioned between the upper pit and the lower pit.

7 Claims, 7 Drawing Sheets

ESCALATOR INSTALLATION METHOD

BACKGROUND OF THE INVENTION

1. Field of the Invention

The present invention relates to an escalator installation method for installing an escalator at a position where a stairway is provided in a station and the like.

2. Description of the Prior Art

Conventionally, as a technique for providing an escalator at a stairway portion forming a pedestrian passage in an architectural structure, those disclosed in, for example, Japanese Patent Application Laid-Open No. Hei7-179282, Japanese Patent Application Laid-Open No. Hei7-179283, and Japanese Patent Application Laid-Open No. Hei7-179284 are known.

These prior arts do not clearly disclose how to install an escalator at a position where a stairway is provided.

SUMMARY OF THE INVENTION

It is an object of the present invention to provide an escalator installation method which ensures an installation operation with the high working efficiency and which is capable of stably installing an escalator.

To this end, according to the present invention, a first drilled portion is formed by drilling an upper floor positioned on an upper side of a stairway; a second drilled portion is formed by drilling a lower floor positioned on a lower side of the stairway; an upper flat portion of the escalator is housed in the first drilled portion of the upper floor; a lower flat portion of the escalator is housed in the second drilled portion of the lower floor; and an inclined portion of the escalator is arranged on the stairway portion positioned between the first drilled portion and the second drilled portion.

Drilling only the first drilled portion accommodating the upper flat portion of the escalator and the second drilled portion for accommodating the lower flat portion of the escalator suffices for the installation method, and the escalator can be installed without the drilling operation over the entire length of the escalator.

DESCRIPTON OF THE EMBODIMENTS

Preferred embodiments of an escalator installation method according to the present invention will now be described hereinafter with reference to the accompanying drawings.

Figure 2:
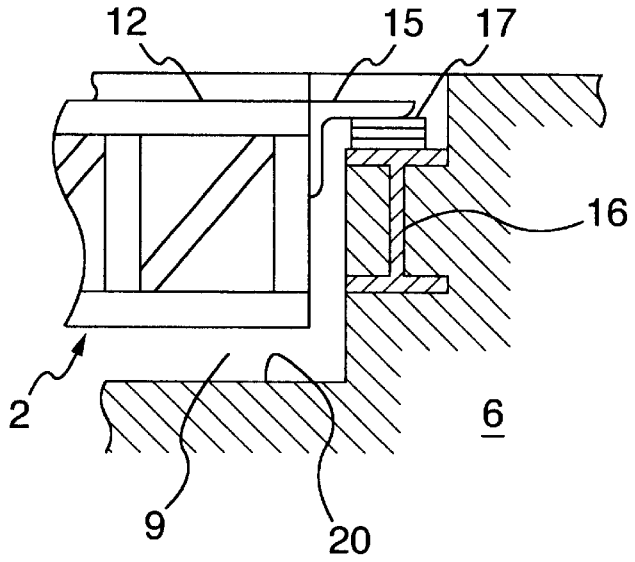
FIG. 2 is an enlarged cross-sectional view showing a part A in FIG. 1.
Figure 3:
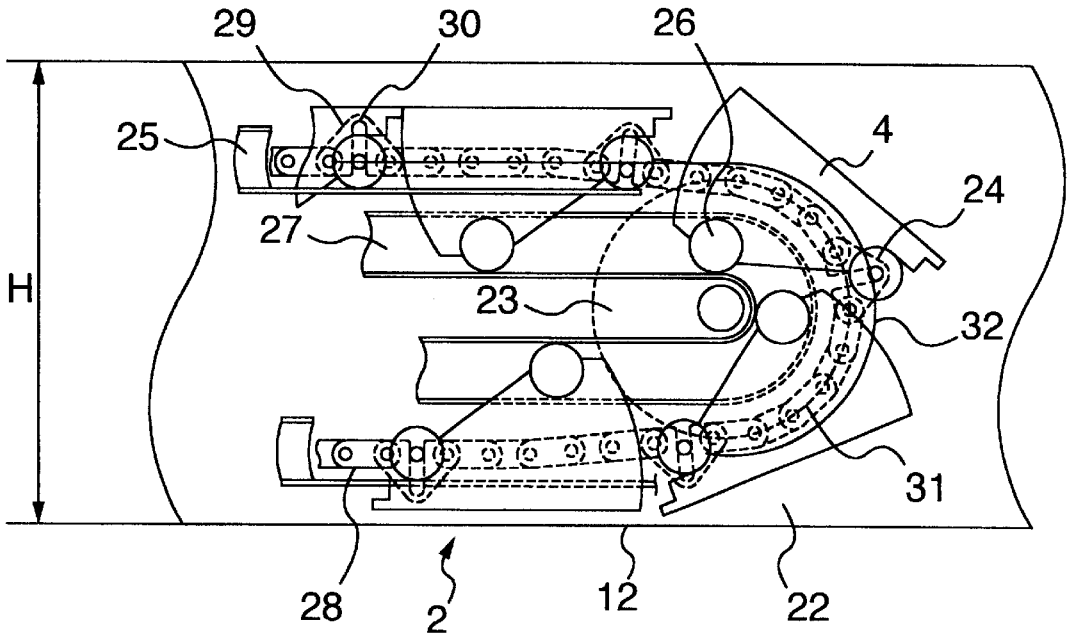
FIG. 3 is an enlarged cross-sectional view showing a primary portion of an internal structure in the vicinity of an upper reverse portion of the escalator illustrated in FIG. 1.

First of all, an escalator which is a target of the present invention will be explained in conjunction with FIGS. 1 to 3. The escalator shown in FIGS. 1 to 3 is, e.g., a thin escalator in which a height of a frame forming a main body is smaller than that in a regular escalator as will be described later.

Figure 1:
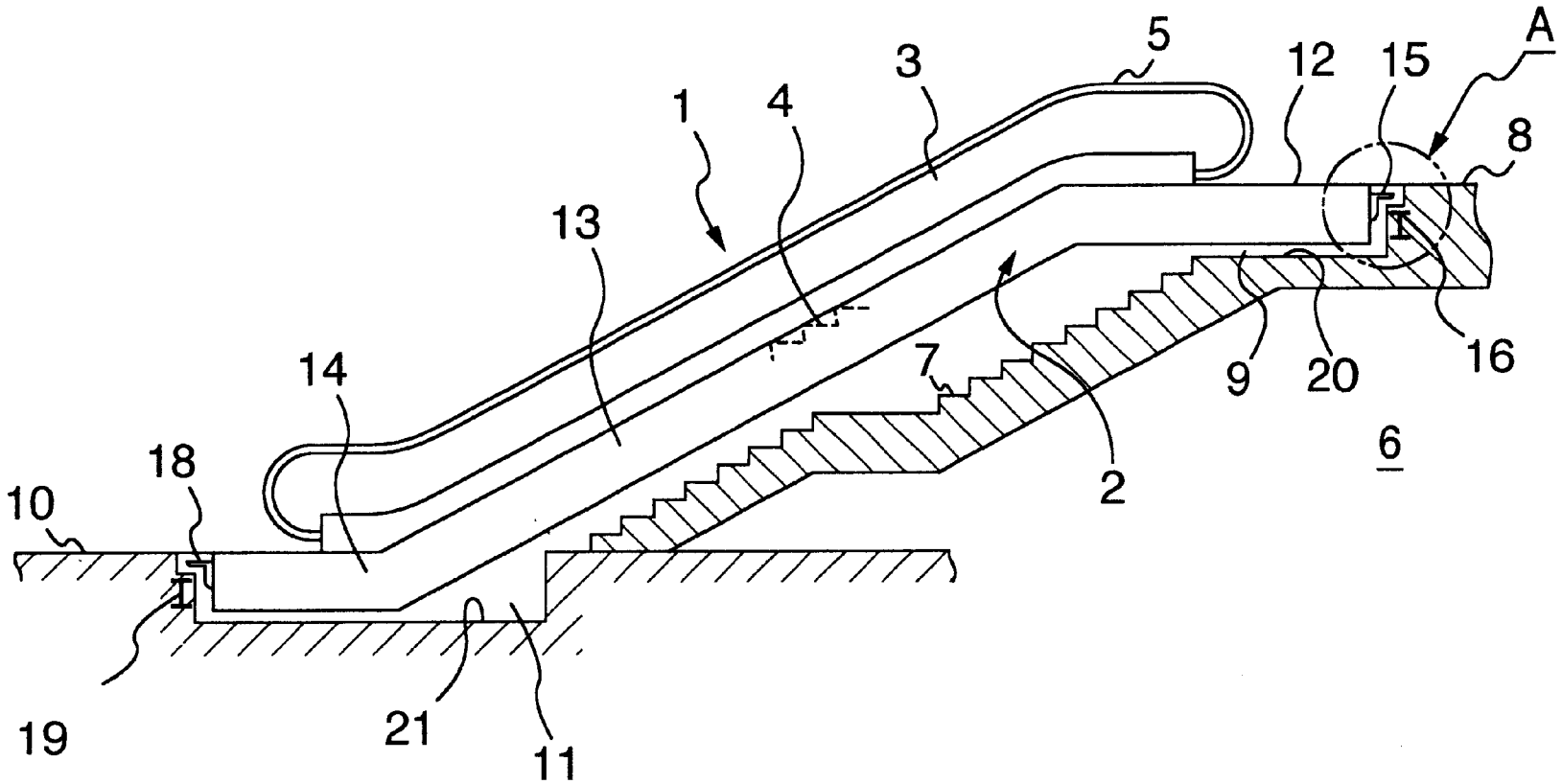
FIG. 1 is a side elevation showing in section a primary part of an escalator installed in accordance with a first embodiment of an escalator installation method of the present invention.

The escalator 1 shown in FIG. 1 includes a frame 2 for forming a main body; a balustrade 3 erected on the frame 2, steps 4 for conveying a passenger, a handrail 5 for moving in synchronism with the steps 4, and others. The escalator 1 depicted in FIG. 1 has such a structure as that the entire frame 2 is constituted by an integral structure and, for example, the balustrade 3 erected on the frame 2, the steps 4 and the handrail 5 are also integrally provided to the frame 2.

An architectural structure 6 provided with the escalator 1 includes a stairway 7, and a first drilled portion, i.e., an upper pit 9 obtained by partially drilling an upper floor positioned on the upper side of the stairway 7, i.e., an upper pit 9 is provided to the upper story floor 8. Further, to a lower floor positioned on the lower side of the stairway 7, i.e., a lower story floor 10 is provided a second drilled portion, i.e., a lower pit 11 obtained by partially drilling the lower story floor 10.

An upper flat portion 12 of the escalator 1 is provided in the upper pit 9 whilst a lower flat portion 14 is provided in the lower pit 10, and an inclined portion 13 is so arranged as to be opposed to the stairway 7.

As shown in FIG. 2, in the escalator 1, an upper end portion 15 of the frame 2 is supported on a building beam 16 through a shim 17. Similarly, as shown in FIG. 1, a lower end portion 18 of the frame 2 is supported on a building beam 19 of the architectural structure 6 through the shim.

Further, the escalator 1 has such a structure as that a part of the upper flat portion 12 positioned below the upper end portion 15 of the frame 2 is distanced from a bottom surface 20 of the upper pit 9 as shown in FIG. 1. Similarly, a part of the lower flat portion 14 positioned below the lower end portion 18 of the frame 2 is distanced from a bottom surface 21 of the lower pit 11.

As shown in FIG. 3, in the escalator 1, a drive sprocket 23 which has a smaller diameter than that in a general escalator and has, e.g., 18 wheel teeth is arranged in the reverse portion 22 of the step 4 provided to the upper flat portion 12 of the frame 2. A front wheel 24 of the step 4 is guided by a front wheel guide rail 25, and a rear wheel 26 of the step 4 is guided by a rear wheel guide rail 27. A movement locus of the front wheel guide rail 25 is positioned outside the rear wheel guide rail 27 in the width direction of the frame 2, i.e., a direction orthogonal to the page of FIG. 3. The front wheel shaft of each step 4 is connected to the chains 28. A triangular specific link 29 is connected to the chains 28 every six links (pitches) and the front wheel shaft is connected to the specific link 29. An oval hole 30 for enabling displacement of the front wheel shaft is formed in the specific link 29. The oval hole 30 is extended in a direction substantially orthogonal to an extensional direction of the chain 28.

Giving description as to the operation of these constituent parts, although the step 4 moving in an outward route becomes close to the reverse portion 22, the tread of the step 4 is turned up and horizontally held and the front wheel shaft is positioned on the lower end of the oval hole 30 of the specific link 29 when the step 4 is still positioned on the near side. During a period in which the step 4 moves from the above-mentioned state and starts to be reversed and the front wheel 24 comes to the vicinity of the substantially center-height position of the drive sprocket 23, the front wheel shaft move so as to be parallel to the extensional direction of the oval hole 30 of the specific link 29 and, when the front wheel comes closer to the substantially intermediate-height position of the drive sprocket 23, the front wheel shaft 24 is positioned on the upper end of the oval hole 30, i.e., the rightmost end in FIG. 3. When the step 4 is further reversed and moves in the inward route with the tread of the step 4 being turned down and horizontally held, the front wheel shaft is again positioned on the lower end of the over hole 30 of the specific link 29.

Such an operation causes the movement locus 31 of the chain 28 and the movement locus 32 of the front wheel shaft of the step 4 to substantially coincide with each other in the outward route to the reverse portion 22 and the inward route after passing the reverse portion 22, but the movement locus 32 of the front wheel shaft is positioned outside the movement locus 31 of the chain 28 in the reverse portion 22. That is, it becomes a movement locus approximating the counterpart of the chain wound around the drive sprocket provided to the regular escalator which is not thin. Therefore, the step 4 which is to be reversed and the step 4 adjacent thereto do not interfere with each other, thereby smoothing the reversal operation of these steps 4.

As described above, since the drive sprocket 23 has a diameter smaller than that in the regular escalator, a height H of the frame 2 illustrated in FIG. 3 can be reduced, e.g., 20 to 30% in the first embodiment as compared with the height of the frame in the regular escalator. Accordingly, the escalator 1 can be constructed as a thin escalator whose overall height is lower than that of the regular escalator.

The first embodiment of the above-described method for installing the escalator 1 to the architectural structure 6 according to the present invention will now be described with reference to FIGS. 4 to 7.

Figure 4:
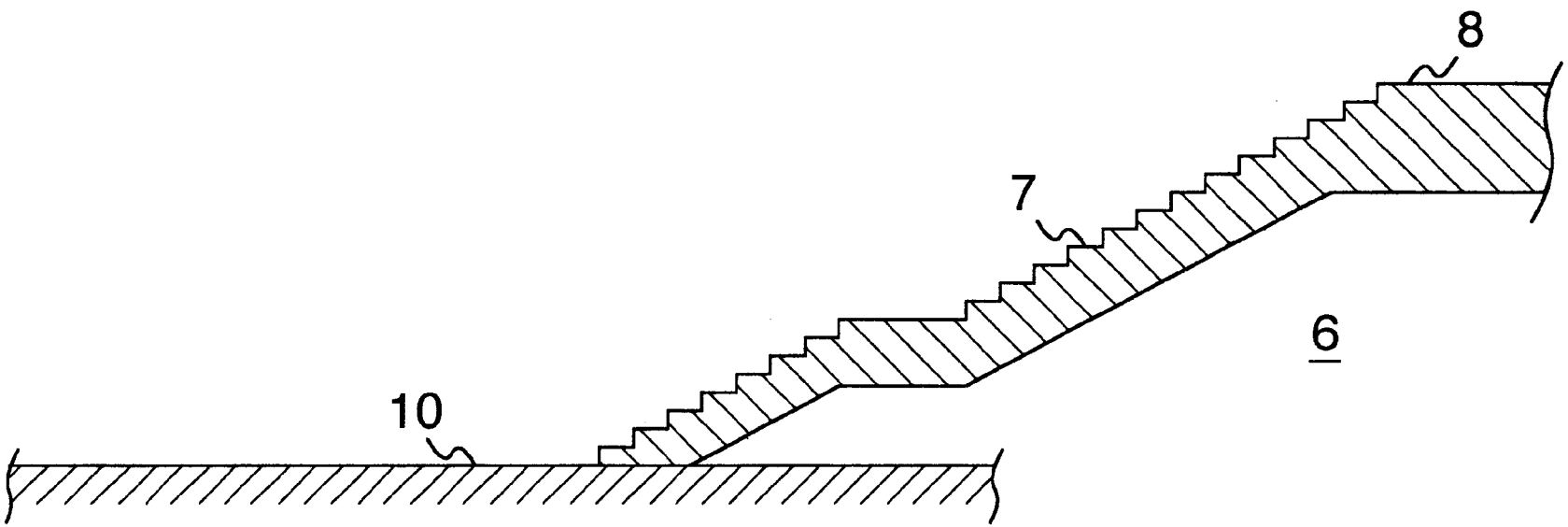
FIG. 4 is a sectional side elevation showing a stairway portion before installing the escalator.

The first embodiment is a method for installing the thin escalator 1 to the aforesaid architectural structure 6 and, as shown in FIG. 4, the architectural structure 6 is provided with the upper story floor 8 and the lower story floor 10, and the stairway 7 forming a pedestrian passage is provided between the upper story floor 8 and the lower story floor 10. This architectural structure 6 is, for example, a railroad station, and the escalator 1 is provided on the existing stairway 7 in the first embodiment.

Figure 5:
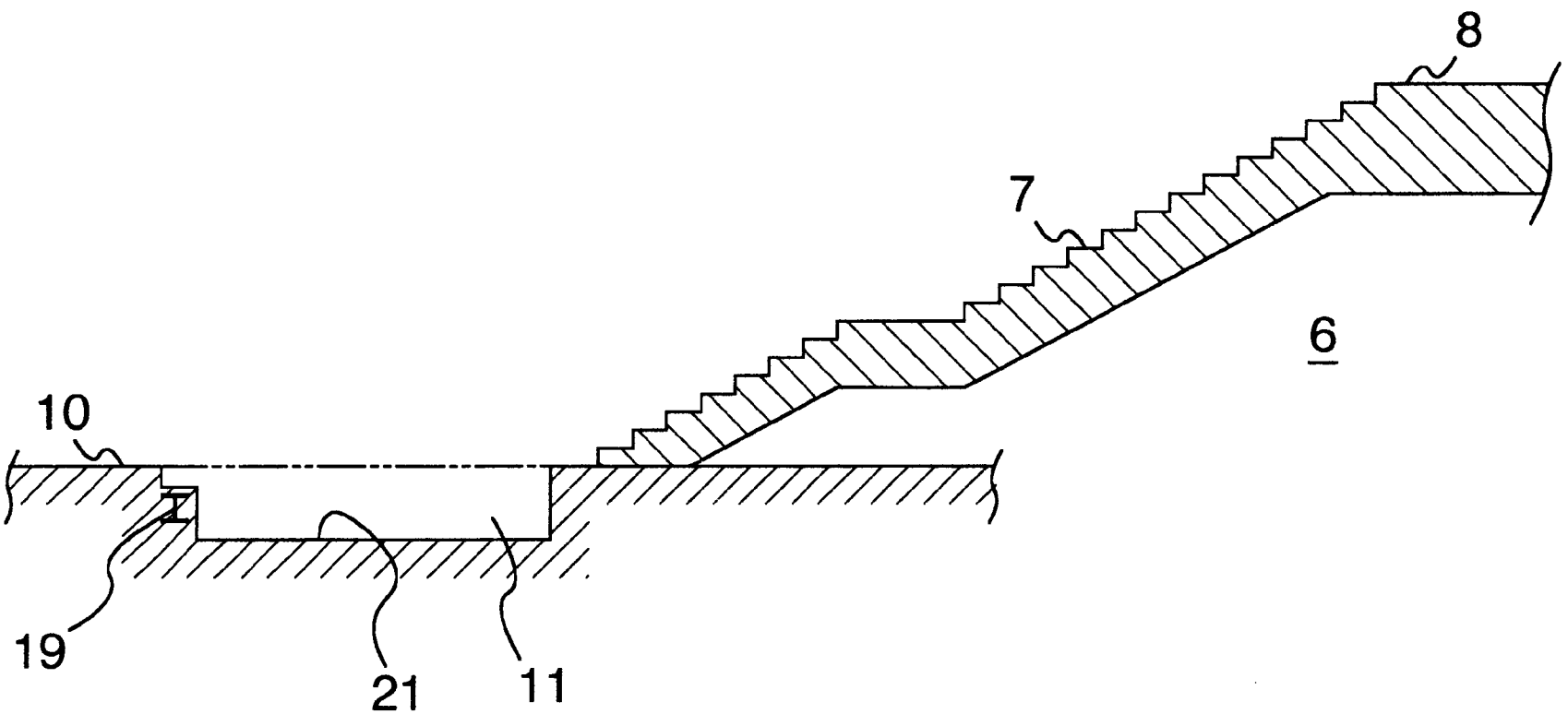
FIG. 5 is a sectional side elevation for explaining a first process in the first embodiment of the escalator installation method according to the present invention.

As shown in, e.g., FIG. 5, a part of the lower story floor 10 positioned in the vicinity of the lowermost portion of the stairway 7 is first drilled to carry out a first process for forming the lower pit 11.

Figure 6:
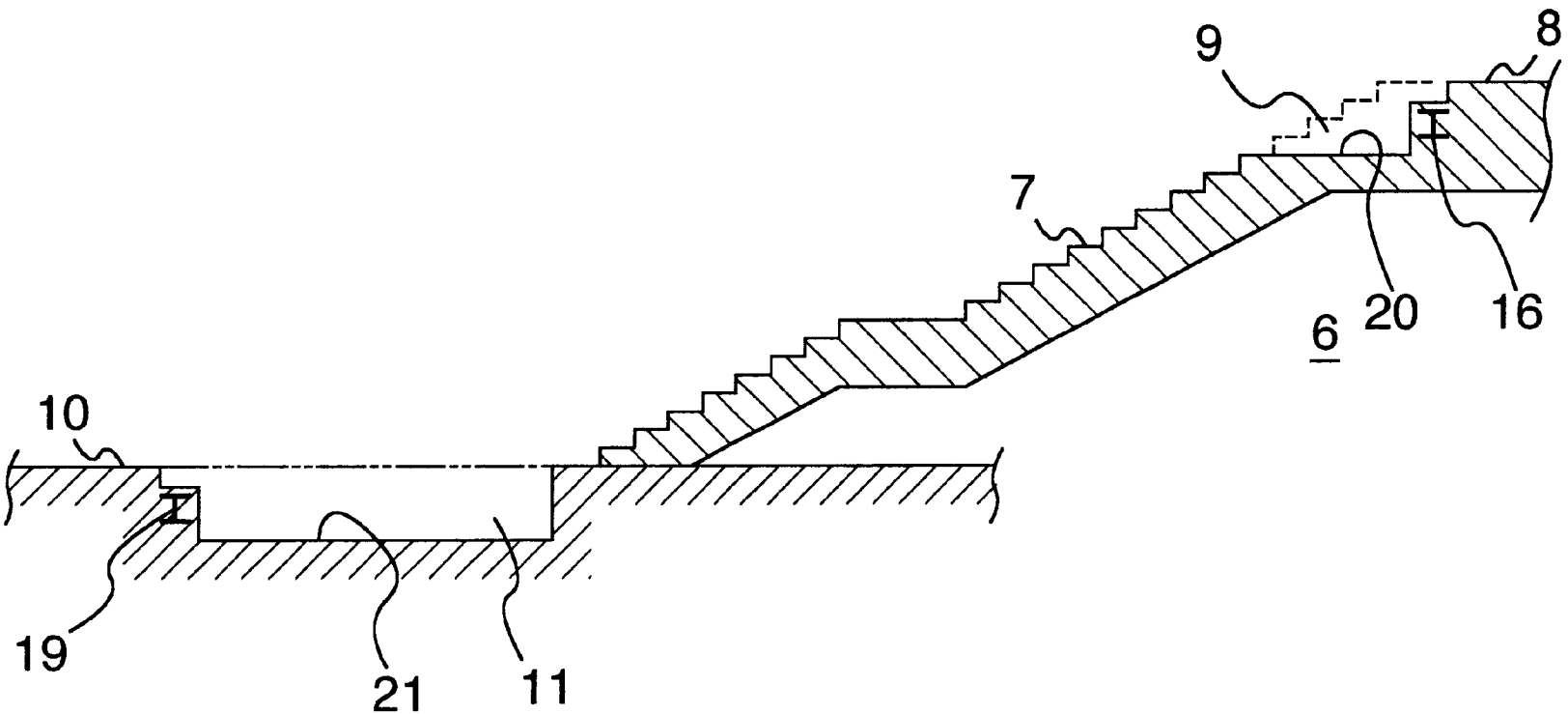
FIG. 6 is a sectional side elevation for explaining a second process in the first embodiment according to the present invention.

The vicinity of the uppermost portion of the stairway 7 and a part of the upper story floor 8 are then drilled to conduct a second process for forming the upper pit 9, as shown in FIG. 6.

Figure 7:
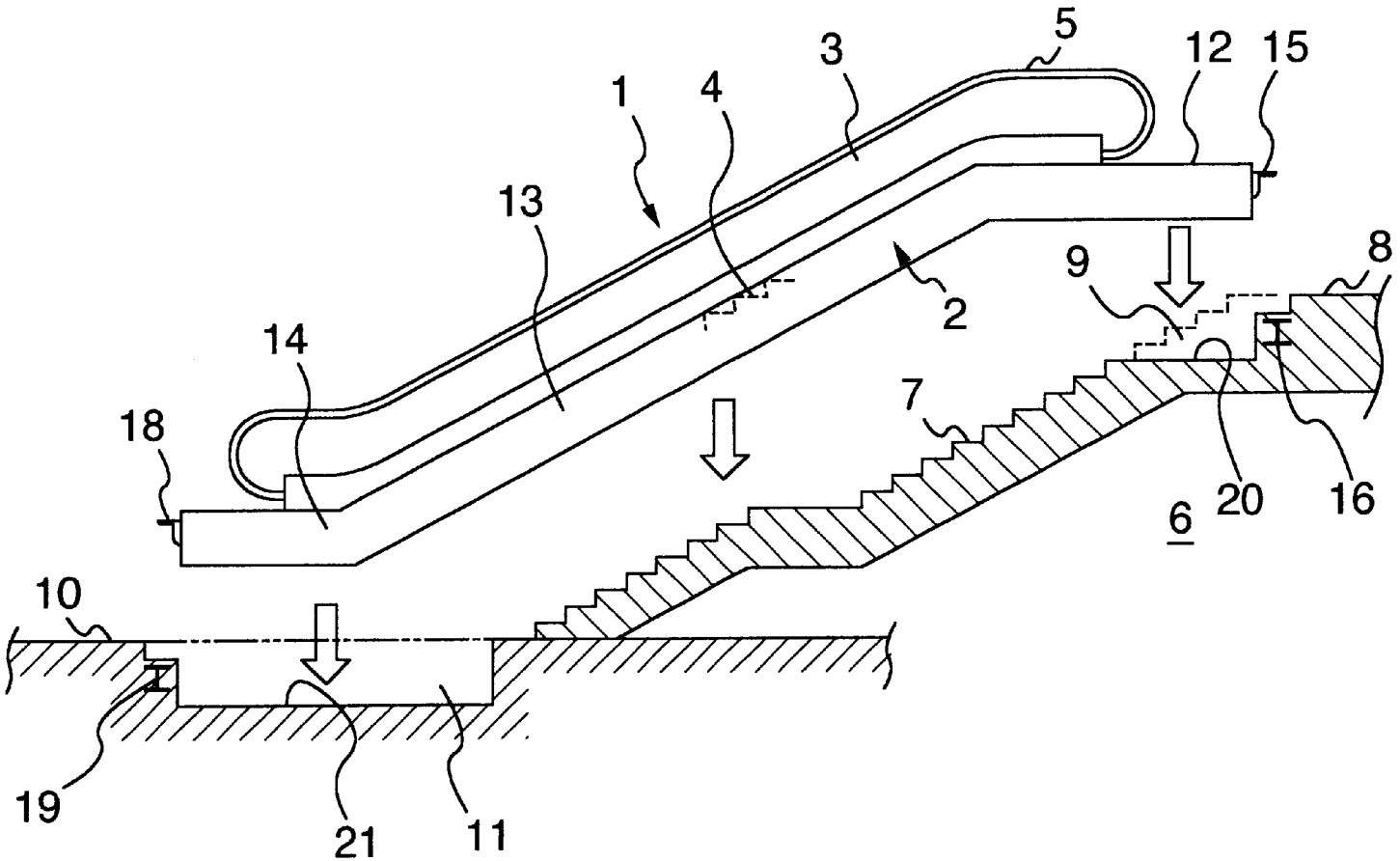
FIG. 7 is a sectional side elevation for explaining a third process in the first embodiment according to the present invention.

At last, as shown in FIG. 7, a part of the stairway 7 positioned between the upper pit 9 and the lower pit 9 are maintained so as not to be drilled, and a third process is performed by which: the escalator 1 constituted by the above-described thin integral structure described with reference to FIGS. 1 to 3 is carried to the stairway 7; the lower flat portion 14 is accommodated in the lower pit 11; the upper flat portion 12 is housed in the upper pit 9; and escalator 1 is installed in such a manner that the inclined portion 13 is arranged above the part of the stairway 7 positioned between the upper pit 9 and the lower pit 11.

In the third process, there are effected an operation for supporting the upper end portion 15 of the frame 2 in the escalator 1 on the building beam 16 of the architectural structure 6 through the shim 17 (FIG. 2) and another operation for supporting the lower end portion 18 of the frame 2 on the building beam 19 of the architectural structure 6 through the shim. In this case, as described above, the part of the upper flat portion 12 positioned below the upper end portion 15 of the frame 2 is so arranged as to be distanced from the bottom surface 20 of the upper pit 9, and the part of the lower flat portion 14 positioned below the lower end portion 18 of the frame 2 is so arranged as to be distanced from the bottom surface 21 of the lower pit 11.

Consequently, as explained above with reference to FIG. 1, the top face of the upper flat portion 12 of the thin escalator 1 and the upper story floor 8 are formed in plane; the top face of the lower flat portion 14 and the lower story floor 10 are formed in plane; and the inclined portion 13 positioned between the upper flat portion 12 and the lower flat portion 14 is installed so as to be distanced away from the stairway 7.

In the first embodiment for installing the escalator in this manner, drilling only the upper pit 9 for accommodating therein the upper flat portion 12 of the escalator 1 and the lower pit 11 for accommodating therein the lower flat portion 14 is sufficient, and the escalator 1 can be installed without requiring the drilling operation over the entire length of the escalator 1, i.e., the chipping operation for the stairway 7. Therefore, a number of processes in the drilling operation can be reduced to improve the installing operation efficiency. This also enables reduction in the time period required for installing the escalator 1, which can satisfy the need for using the escalator as soon a s possible.

In addition, since the thin escalator 1 is installed in the first embodiment, although not shown in FIG. 1 and others, the sufficient height from the stairway 7 to a ceiling portion can be assured if the architectural structure 6 has the ceiling portion, and no problem occurs in conveyance of passengers by this escalator 1.

Since the entire escalator 1. including the frame 2, is constituted by the integral structure, the operation for connecting the frame is not required in the installation on the spot, which further reduces a number of processes in the installing operation, contributing to improvement in the operation efficiency.

Furthermore, since the upper end portion 15 of the frame 2 in the escalator 1 is supported on the building beam 16 of the architectural structure 6 and the lower end portion 18 of the frame 2 is supported on the building beam 19 of the architectural structure 6, the building beams 16 and 19 receive a load of the escalator 1, which can stabilize the escalator 1, thereby realizing the installation with high accuracy.

Moreover, since the part of the upper flat portion 12 positioned below the upper end portion 15 of the frame 2 is lifted above the bottom surface 20 of the upper pit 9 and the part of the lower flat portion 14 positioned below the lower end portion 18 is lifted above the bottom surface 21 of the lower pit 11, the load of the escalator 1 is not transmitted to the bottom surface 20 of the upper pit 9 and the bottom surface 21 of the lower pit 11, and the safety protection for the installation environment of the escalator 1 can be realized without a concern of a deformation of or a damage to the bottom surfaces 20 and 21.

Figure 8:
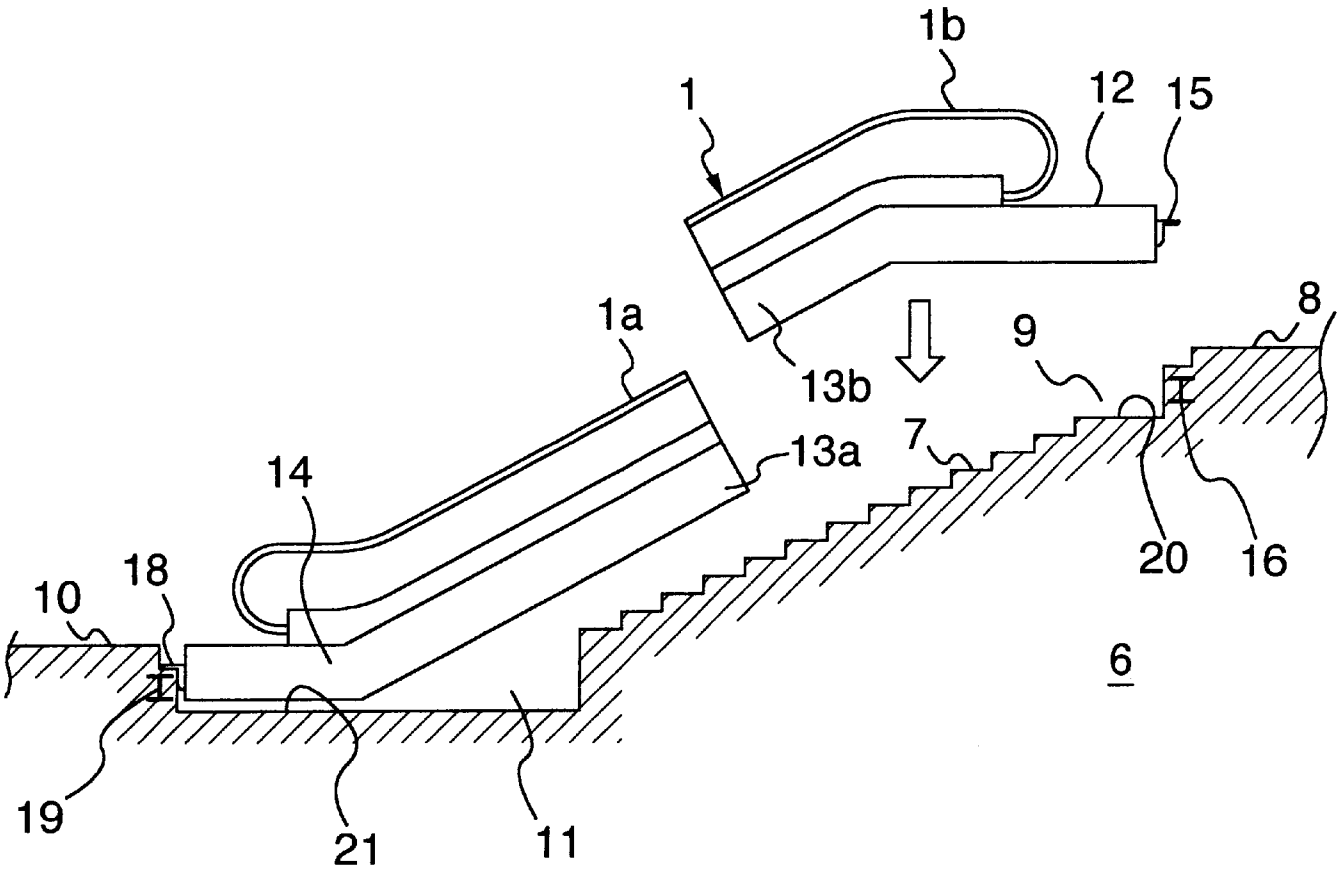
FIG. 8 is a side elevation showing a primary portion in section for explaining a second embodiment of the present invention.

FIG. 8 is a side elevation showing a primary part in section for explaining a second embodiment of an installation method according to the present invention.

In this second embodiment, the escalator 1 is constituted by a thin escalator and includes, for example, a lower divided portion 1*a* including a frame first divided portion 13*a* and an upper divided portion 1*b* including a frame second divided portion 13*b*.

In the second embodiment, as similar to, e.g., the first embodiment described above, a part of the lower story floor 10 positioned in the vicinity of the lowermost portion of the stairway 7 is drilled to form the lower pit 11 as the first process.

Subsequently, as the second process, the vicinity of the uppermost portion of the stairway 7 and a part of the upper story floor 8 are drilled to form the upper pit 9.

The part of the stairway 7 positioned between the upper pit 9 and the lower pit 11 is maintained so as not to be drilled.

In case of installation from, e.g., the lower story floor 10 in this state, the lower flat portion 14 included in the lower divided portion 1*a* is provided in the lower pit 11 with no upper divided portion 1*b* existing in the installation position of the escalator 1, and the upper flat portion 12 included in the upper divided portion 1*b* is then provided in the upper pit 9. Thereafter, the lower divided portion 1*a* and the upper divided portion 1*b* are connected to each other.

On the contrary, in case of installation from the upper story floor 8, the upper flat portion 12 included in the upper divided portion 1*b* is provided in the upper pit 9 with no lower divided portion 1*a* existing in the installation position of the escalator 1, and the lower flat portion 14 included in the lower divided portion 1*a* is then provided in the lower pit 11. Subsequently, the upper divided portion 1*b* and the lower divided portion 1*a* are connected to each other.

In any of the above-described methods, the operation is carried out by which the lower end portion 18 of the lower divided portion 1*a* is supported on the building beam 19 of the architectural structure 6 through the shim; the upper end portion 15 of the upper divided portion 1*b* is supported on the building beam 16 of the architectural structure 6 through the shim; the part of the lower flat portion 14 positioned below the lower end portion 18 of the lower divided portion 1*a* is arranged so as to be distanced from the bottom surface 21 of the lower pit 11; and the part of the upper flat portion 12 positioned below the upper end portion 15 of the upper divided portion 1*b* is arranged so as to be distanced from the bottom surface 20 of the upper pit 9.

In the second embodiment for installing the escalator in this manner, the part of the stairway 7 positioned between the upper pit 9 and the lower pit 11 is not drilled, and hence the results similar to those in the first embodiment can be obtained.

In particular, when installing from the lower story floor 10, the lower divided portion 13*a* is carried to the vicinity of the lower pit 11 to be set to a predetermined position with no upper divided portion 13*b* existing in the installation position of the escalator 1. Further, when installing from the upper story floor 8, the upper divided portion 13*b* is carried to the vicinity of the upper pit 9 to be set to a predetermined position with no lower divided portion 1*a* existing in the installation position of the escalator 1. As a result, the operation for installing the escalator 1 can be performed without hindrance or interference of the divided portions, which contributes improvement in the operation efficiency.

Although a number of processes in the installation operation is increased because of the operation for connecting the lower divided portion 1*b* to the upper divided portion 1*a* as compared with the installation of the escalator 1 constituted by the integral structure including the frame 2 in the above-described first embodiment, the respective divided portions 1*b* and 1*a* can be readily treated since the these divided portions 1*b* and 1*a* are light in weight as compared with the escalator which is entirely constituted by the integral structure, and the installation operation can be thereby facilitated, which contributes to improvement in the operation efficiency.

Although the thin escalator 1 is installed in the foregoing embodiments, the conventionally-used regular escalator may be installed if the ceiling portion has a sufficient height.

In addition, although the lower pit 11 is formed by drilling as the first process and the upper pit 9 is formed by drilling as the second process in the respective embodiments, the present invention is not restricted to these processes, and the upper pit 9 may be formed by drilling as the first process and the lower pit 11 may be formed by drilling as the second process.

Moreover, the escalator 1 is supported by the both building beams 16 and 19 of the architectural structure 6 in the foregoing embodiments, but it may be supported by either one. Further, the escalator 1 may be supported by any other support without using the building beams 16 and 19.

Although the part of the upper flat portion 12 positioned below the upper end portion 15 of the escalator 1 and the part of the lower flat portion 14 positioned below the lower end portion 18 are distanced from the bottom surface 20 of the upper pit 9 and the bottom surface 21 of the lower pit 21, respectively, in the foregoing embodiments, either of these parts may be mounted on the bottom surface of the pit. If the sufficient strength of the bottom surface of the pit is assured, the both parts may be mounted on the bottom surfaces of the pits.

Although the escalator 1 takes the shape of the integral structure in the first embodiment, only the frame 2 may be constituted by the integral structure and other members such as the balustrade 3, the step 4 and the handrail 5 may be disposed after carrying in the frame 2.

Similarly, the lower divided portion 1*a* takes the shape of the integral structure including the frame first divided portion 13*a*, the balustrade portion, the step portion and the handrail portion and the upper divided portion 1*b* takes the form of another integral structure including the frame second divided portion 13*b*, the balustrade portion, the step portion and the handrail portion in the second embodiment, the balustrade, the step, the handrail and others may be disposed after carrying in the frame first divided portion 13*a* and the frame second divided portion 13*b*, respectively.

The escalator 1 is constituted by the two divided portions in the second embodiment, but it may be constituted by three or more divided portions.

Although the thin escalator 1 is likewise installed in the second embodiment, the regular escalator may be constituted in the divided manner when installing the escalator at the position where the sufficient upper space can be assured.

As described above, according to the present invention, the escalator can be installed without requiring the drilling operation over the entire length of the escalator to thereby reduce a number of processes in the drilling operation, and the drilling operation efficiency can be improved as compared with the prior art. As a result, the time period required in the installation of the escalator can be further reduced as compared with the prior art, which can satisfy the need for using the escalator as soon as possible.

What is claimed is:

1. An escalator installation method for installing a thin escalator at a position where a stairway is provided, said thin escalator including steps each having a front wheel and a rear wheel and being guided by a guide rail mounted in a frame forming a thin escalator main body, a chain for connecting and moving said steps, and a sprocket for driving said chain wound thereon so that a movement locus of a shaft of said front wheel is positioned outside a locus of said chain in a reverse portion of said steps, the escalator installation method comprising the steps of:

forming a first drilled portion by drilling an upper floor positioned on an upper side of said stairway and forming a second drilled portion by drilling a lower floor positioned on a lower side of said stairway; and accommodating an upper flat portion of said thin escalator in said first drilled portion of said upper floor and accommodating a lower flat portion of said thin escalator in said second drilled portion of said lower floor so that an inclined portion of said thin escalator is arranged on a part of said stairway positioned in the middle of said first drilled portion and said second drilled portion.

2. An escalator installation method according to claim 1, wherein said frame forming said thin escalator main body has a height smaller than that of a regular frame for a non-thin escalator.

3. An escalator installation method according to claim 1 or 2, wherein said frame forming said thin escalator main body is constituted by an integral structure.

4. An escalator installation method according to claim 1 or 2, wherein said frame forming said thin escalator main body is constituted by connecting a plurality of divided portions to each other.

5. An escalator installation method according to claim 1 or 2, wherein at least one of an upper end portion and a lower end portion of said frame forming said thin escalator main body are supported by building beams provided to an architectural structure to which said thin escalator is set.

6. An escalator installation method according to claim 1 or 2, wherein an upper flat portion and a lower flat portion of said frame forming said thin escalator main body are arranged so as to be distanced from bottom surfaces of said first drilled portion and said second drilled portion, respectively.

7. An escalator installation method according to claim 4, wherein when carrying in said divided portions of said frame from said lower floor to a predetermined installation position, one divided portion corresponding to said lower flat portion is provided in said second drilled portion and another divided portion corresponding to said upper flat portion is then provided in said first drilled portion, and wherein when carrying in said divided portions of said frame from said upper floor to a predetermined position, said another divided portion corresponding to said upper flat portion is provided in said first drilled portion and said one divided portion corresponding to said lower flat portion is then provided in said second drilled portion.

* * * * *